United States Patent [19]

Mays

[11] Patent Number: 4,660,736

[45] Date of Patent: Apr. 28, 1987

[54] RESEALABLE SHIPPING CONTAINER

[75] Inventor: Terrell L. Mays, Ridgefield, Conn.

[73] Assignee: Stauffer Chemical Company, Westport, Conn.

[21] Appl. No.: 851,627

[22] Filed: Apr. 14, 1986

[51] Int. Cl.[4] ..... B65D 45/00

[52] U.S. Cl. ..... 220/327

[58] Field of Search ..... 220/327, 315, 314, 328

[56] References Cited

U.S. PATENT DOCUMENTS

| | | | |
|---|---|---|---|
| 1,021,066 | 3/1912 | Noakes | 220/314 |
| 2,590,803 | 3/1952 | Unger et al. | 220/328 |
| 2,661,974 | 12/1953 | Zehinder | 220/314 |
| 4,494,666 | 1/1985 | Cooper et al. | 220/327 |

*Primary Examiner*—George T. Hall

*Attorney, Agent, or Firm*—Roger S. Benjamin

[57] ABSTRACT

A shipping container is positively resealed by an auxiliary cover. The shipping container and auxiliary cover have a plurality of flanges with coupling holes. The flange holes are aligned and held in position by coupling pins with retaining means.

12 Claims, 1 Drawing Figure

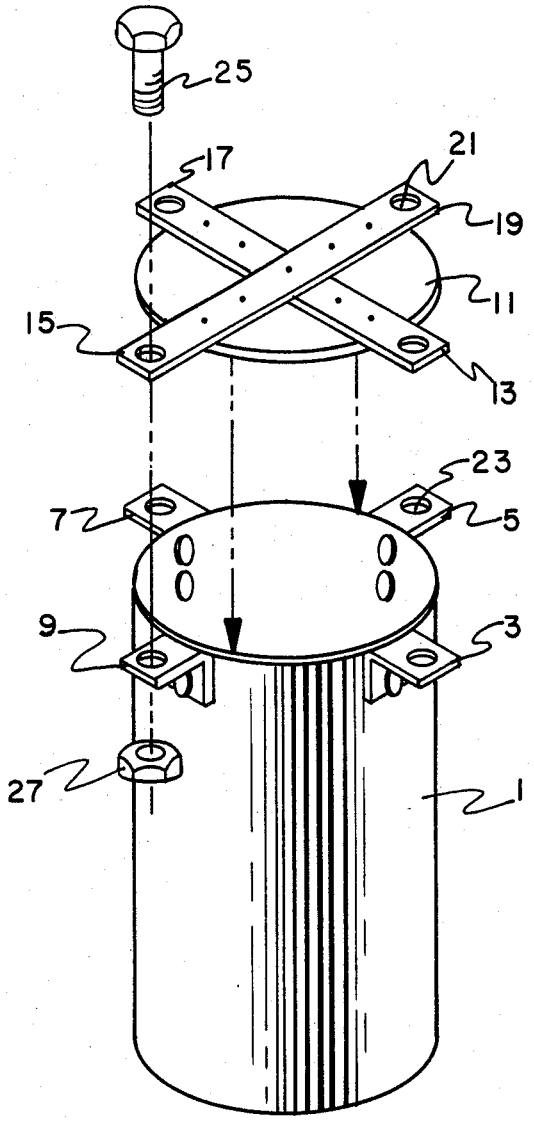
25
17
21
19
11
15
13
23
7
5
9
3
27
1

RESEALABLE SHIPPING CONTAINER

BACKGROUND OF THE INVENTION

Many shipping containers for hazardous materials are conventionally designed as single use packages to be sent to a purchaser in the form of a sealed secure package without provision for positive reclosure upon reuse or return. Shipping container construction having one-time positive closure means is exemplified by a metal canister with a soldered or seamed-on cover. The act of opening these types of covers destroys the positive closure feature of the container and makes it unsuitable for return shipment of hazardous materials.

Department of Transportation Regulation Title 49 for pyrophoric liquids, NOS (not otherwise specified) sections 173.134(a) (2) and (a) (3) set out the requirements for shipping small quantities of pyrophoric liquids. The regulation specifies in (a) (2) that certain wooden or fiber board boxes enclosing strong tight metal cans with glass or metal not over one quart capacity and in (a) (3) metal drums not over 1 gallon capacity, constructed of not less than 28 gauge electro-coated tin plate are to be closed by positive means, not friction.

Electronic chemicals which are pyrophoric liquids such as triethyl aluminum, trimethyl gallium, dimethyl zinc, and triethyl indium are shipped in valved stainless steel strong metal packages packed in cushioning material (e.g., vermiculite) in shipping containers conforming to Section 173.134(a) (2) and (a) (3).

Typically, after customer use, the stainless steel strong metal packages contain residual pyrophoric liquid. The customer must either clean the cylinder or return it to the distributor with the same shipping precautions with which it was sent.

It is desirable to develop a shipping container that may be resealed in a positive manner to permit its return or reuse.

FIELD OF THE INVENTION

This invention relates to the construction of novel shipping containers.

DETAILED DESCRIPTION OF THE INVENTION

The invention is a shipping container having provision for positive reclosure. The container has the following essential elements of structure:

(a) a container body circumscribing a storage volume and having an opening;

(b) a container resealing cover having dimensions sufficient to at least cover the opening of the container body;

(c) a plurality of external, right angle, radially outward extending flanges attached to the container body, the flanges each having a coupling hole with the coupling hole being on the portion of the flange planer with the container opening;

(d) a plurality of substantially flat, radially outward extending flanges attached to the container resealing cover, said flat flanges extending beyond the cover perimeter and each having a coupling hole in the perimeter extending portion;

(e) a plurality of coupling pins, each capable of placement into the container and cover flange coupling holes, each pin further having retaining means for securing its placement in a flange hole.

The above described container flanges and cover flanges are cooperatively positioned so that placement of the cover on the container juxtaposes a cover flange and a container flange to give a flange pair with aligned coupling holes. A coupling pin resides in the aligned holes to secure the resealing cover to the container body.

The shipping container of the invention may be any convenient shape. Generally, a cylindrical, square, or rectangular (hexahedral) container configuration is preferred. The container may be formed from any material conventionally used for such purpose, for example, plastic, wood, cardboard, or metal. A preferred material for canister construction is set out in DOT regulation, Title 49, Section 173.134(a) (2) and (a) (3), specifically, a metal canister formed from at least 28 gauge steel.

The material of construction of the flanges is not critical and includes metal or plastic. Moreover, the flanges may be connected to the container body and the container cover by any conventional means such as adhesives, rivets, screws, or nuts and bolts.

The resealing cover will positively reseal the container if at least two flange pairs (approximately diametrically opposed on the cover) are used. It is preferred to use three or four flange pairs and arrange the flanges uniformly on the perimeter of the resealing cover.

The coupling hole in the flanges on the canister body and cover may be openings of any shape suitable for insertion of a coupling or connecting pin. A preferred hole has a circular shape and is capable of admitting ordinary round screws, bolts, pins and rivets.

The coupling pin and retaining means placed in the aligned pairs of flange holes serves to positively seal the replacement resealing cover on the container. Useful coupling pins, as defined by this invention, include metal tapping screws, nuts with bolts, cotter pins, twisted wire, and rivets.

This invention also includes a shipping canister package comprising a canister with seamed on closure together with an auxiliary canister resealing cover. The canister and resealing cover both being equipped with flanges as previously described for the shipping container of this invention.

BRIEF DESCRIPTION OF THE DRAWING

The present invention will be more readily understood by reference to the following DRAWING which is an exploded perspective view of preferred embodiment of the shipping container with resealing cover of this invention:

Container (1) is externally equipped with right angle outward extending flanges (3), (5), (7), and (9). Cover (11) is equipped with perimeter extending flanges (13), (15), (17), and (19). Each flange includes a coupling hole typlified by holes (21) and (23).

The arrows of the FIGURE illustrate that placement of the cover to the container aligns coupling holes in pairs of flanges containing one flange from the container and one flange from the cover. A coupling pin typlified by bolt (25) and nut (27) positively retains flanges (15) and (9). Similar bolt and nut retaining means would be used on flange pairs (3) and (13), (5) and (19), and (7) and (17) to provide a resealed container.

It should be understood that the drawing is merely illustrative of the invention and the claims are not intended to be limited thereby.

I claim:

1. A container having provision for positive reclosure which comprises as essential elements:

(a) a container body circumscribing a storage volume and having an opening;

(b) a container resealing cover having dimensions sufficient to at least cover the opening of the container body;

(c) a plurality of external, right angle, radially outward extending flanges attached to the container body, said flanges each having a coupling hole, the coupling hole being on the portion of the flange planar with the container opening;

(d) a plurality of substantially flat, radially outward extending flanges attached to the container resealing cover, said flat flanges extending beyond the cover perimeter and each having a coupling hole in the perimeter extending portion;

(e) a plurality of coupling pins each capable of placement into the container and cover flange coupling holes, each pin further having retaining means for securing its placement in a flange hole;

wherein, the container flanges and the cover flanges are cooperatively positioned so that placement of the cover on the container juxtaposes a cover flange and a container body flange to form a flange pair with aligned coupling holes in each flange pair wherein a coupling pin with retaining means resides in the aligned holes.

2. The shipping container of claim 1 wherein the container volume describes a cylinder.

3. The shipping container of claim 1 wherein the canister volume describes a hexahedron.

4. The shipping container of claim 1 wherein the cover flanges are substantially uniformly distributed on the perimeter of the cover.

5. The container of claim 4 having two cover flanges.

6. The container of claim 4 having three cover flanges.

7. The container of claim 4 having four cover flanges.

8. The container of claim 1 wherein the flanges are attached to the container cover and container body with rivets.

9. The container of claim 1 wherein the coupling pins are nuts and bolts.

10. The container of claim 1 wherein the coupling pins are cotter pins.

11. The container of claim 1 wherein the coupling pins are rivets.

12. A shipping canister package comprising a canister with a seamed on closure and an auxiliary canister resealing cover, said canister and cover having as essential elements:

(a) a canister body circumscribing a storage volume and having an opening;

(b) a canister resealing cover having dimensions sufficient to at least cover the opening of the canister body;

(c) a plurality of external, right angle, radially outward-extending flanges attached to the canister body, said flanges each having a coupling hole, the coupling hole being on the portion of the flange planar with the canister opening;

(d) a plurality of substantially flat, radially outward extending flanges attached to the canister resealing cover, said flat flanges extending beyond the cover perimeter and each having a coupling hole in the perimeter extending portion;

(e) a plurality of coupling pins each capable of placement into the canister and cover flange coupling holes, each pin further having retaining means for securing its placement in the flange holes;

wherein, the canister flanges and the cover flanges are cooperatively positioned so that placement of the cover on the canister juxtaposes a cover flange and a canister body flange to form a flange pair that aligns coupling holes in each pair to receive the coupling pin with retaining means.

* * * * *